US005121538A

United States Patent [19]

Kerr

[11] Patent Number: 5,121,538

[45] Date of Patent: Jun. 16, 1992

[54] DECELERATION METHOD AND APPARATUS FOR A MOVING BOLSTER FOR A PRESS

[75] Inventor: Peter Kerr, Columbus, Ohio

[73] Assignee: Schuler Incorporated, Columbus, Ohio

[21] Appl. No.: 545,701

[22] Filed: Jun. 29, 1990

[51] Int. Cl.[5] ..... B21J 13/08; B23Q 3/155

[52] U.S. Cl. ..... 483/7; 72/446; 72/448; 483/28; 83/563; 100/918; 91/454

[58] Field of Search ..... 29/568; 83/563; 72/446, 72/448; 91/433, 454; 100/918

[56] References Cited

U.S. PATENT DOCUMENTS 4,433,620 2/1984 Kiyosawa ..... 72/446 X 4,630,536 12/1986 Shah ..... 72/448 X

*Primary Examiner*—Z. R. Bilinsky

*Attorney, Agent, or Firm*—Vorys, Sater, Seymour & Pease

[57] ABSTRACT

A method and apparatus for changing dies on a moving bolster for a press including a control circuit in combination with a cam-actuated deceleration valve. A ramp is located at a predetermined location along a path for the moving bolster. Upon reaching the ramp location when the bolster is moving toward the press, the deceleration valve is actuated to inhibit and shut off a flow of air to air-operated motors on the bolster. Thereupon, the moves to a stop at a predetermined location relative to the press.

5 Claims, 4 Drawing Sheets 73
29
90
72

DECELERATION METHOD AND APPARATUS FOR A MOVING BOLSTER FOR A PRESS

BACKGROUND OF THE INVENTION

This invention relates to a method and apparatus for changing dies on a moving bolster for a press, particularly a large press. More particularly, this invention relates to a hydraulic control circuit for the moving bolster to decelerate the moving bolster to a smooth stop within the press. Still more particularly, this invention relates to a rotary valve for use in a circuit of the type described for controlling the movement of a moving bolster during die changing.

Large presses are well known for making large items such as automobile body parts by pressing a metal blank. Typically, such presses include a press body and a pressing apparatus for pressing a metallic blank inserted intermediate the pressing apparatus and a die positioned in a bolster. It is a continuing problem in this art to provide a means for changing dies on a bolster to facilitate die changes within the press.

A typical arrangement utilizes a moving bolster. For a die change, the bolster containing the existing die, for forming automobile side panels for example, is withdrawn from the press. Then, the automobile side panel die is removed from the bolster and another die, such as a hood die, is secured to the bolster. Thereafter, the bolster with the hood die attached is moved into position within the press and secured at that point. The art of presses, moving bolsters, and securing dies to the moving bolster is well-developed.

However, it remains a problem in this art to expedite die changes. In addition to minimizing production interruption for a die change in normal circumstances, it is desired to minimize inventory of a particular part for cost reasons. Thus, while large numbers of a particular part might be pressed before changing to another part because of the long time needed to change the dies, now it is a significant desire in the art to produce fewer parts before a die change. This requires therefore that die changes be expedited and completed in a short time.

Such presses are massive with capacities up to hundreds of tons of pressure to be exerted on dies which can weigh in the order of 40 or 50 tons. Accordingly, the bolsters and the dies are able to withstand such pressures in the pressing operation, largely through their size and structure. It is a problem, however, when undergoing expedited die changing of the type described, to move such massive parts in a way which satisfactorily controls movement and momentum of the combination, both in withdrawing the die/bolster combination from the press, but particularly in inserting the new die/bolster combination into the press. It is of course desirable to move the die and bolster as promptly as possible, but a risk of damage to the equipment for failure to stop adequately must be avoided given the masses involved.

Accordingly, it is a problem in this art to provide a control circuit, such as pneumatic control circuit compatible with typical control circuits for moving such equipment, which can control acceleration, deceleration, and stopping of such equipment.

It is another problem in this art to automate such stopping particularly within the press, since operator judgment if faulty can cause significant damage for failure of the equipment to stop precisely within the press. Thus, it is desired to provide a circuit which is responsive to a ramp on the track of travel to initiate deceleration and stoppage.

It is another problem in this art to provide a control valve responsive to the ramp for use in the hydraulic circuit of the invention to control deceleration and stoppage of the die and bolster at a predetermined time, with a desired hold and subsequent release of the pneumatic braking.

These and other objects of the invention will be apparent from a detailed description of the invention which follows.

BRIEF SUMMARY OF THE INVENTION

Directed to achieving the foregoing objectives, one aspect of the invention relates to a pneumatic circuit for controlling deceleration of a moving bolster to achieve a controlled stop for a die and bolster combination. The circuit includes an air supply in circuit with a pilot operating 4-way 2-position valve for providing air to a pair of quick exhaust, directional valves for providing air to a deceleration valve according to the invention. The deceleration valve permits forward movement of the air motor through a control valve until its cam-operated member is actuated by contact with a ramp on the track for the bolster at a predetermined location near or within the press. The location is determined so that the deceleration valve and circuit can operate to provide a controlled stop to the equipment. When the cam-actuated member is operated, the forward air supply is interrupted, while permitting the bolster to move to a stop, either by its own momentum or by the use of a reverse air supply initiated to provide reverse air for the motor under the control of a cam operated valve or both. In any case, the cam also sets the circuit to a reverse mode, so that the bolster and die can be withdrawn on its next cycle. Thereupon, the die/bolster combination decelerates to a controlled stop within the press.

A significant advantage of the invention is that it permits significant increases in the speed of movement of the bolsters since the deceleration and stoppage of the bolster is controlled. Speeds of 30 to 35 feet per minute are possible as compared to an average speed for the bolsters before modification of about 10 to 15 feet/-min.

The deceleration valve according to the invention is mounted to the bolster and is activated by a cam mounted on the press bed. The main air lines running to the motor are then rerouted through the deceleration valve which in turn reduces the volume of air to the motor when activated by the cam causing the motor to slow down. It is a feature of the valve according to the invention to provide a controlled clearance, such as 0.010 in. clearance between the spool and the valve body, thus allowing an internal by-pass of air to the motor after the valve is closed by the cam. The by-pass air is used to bleed down air trapped in the circuit after controlled stop. The deceleration valve also causes the bolster to idle onto its stop at about 2 ft/min by its structure in combination with the control circuit.

It is another feature of the invention that, when the bolster is on its stop, the main air supply is shut off. A column of air is trapped between the motor and the deceleration valve which allows he bolster to maintain a load on the stop while the bolster is lowered onto the press bed. The column of air is bled off to atmosphere through a small air jet with a short blow-down time of about 20 seconds.

These and other features of the invention will become apparent from a detailed description of the invention which follows taken in conjunction with the accompanying drawings.

DETAILED DESCRIPTION OF THE PREFERRED EMBODIMENT

Figure 1:
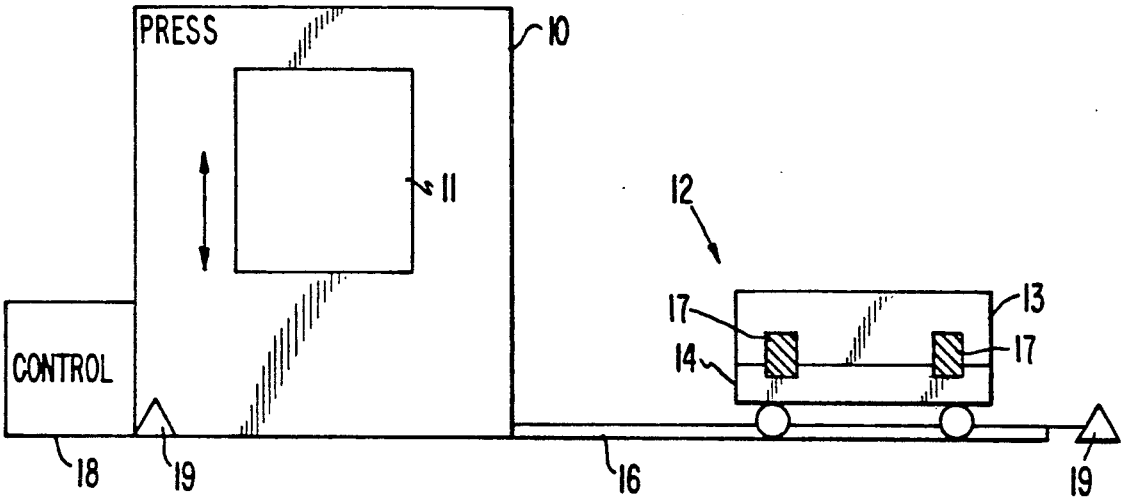
FIG.1 (PRIOR ART)
FIG. 1 is a schematic view of the major components of a conventional controlled moving bolster arrangement for a press.
Figure 2:
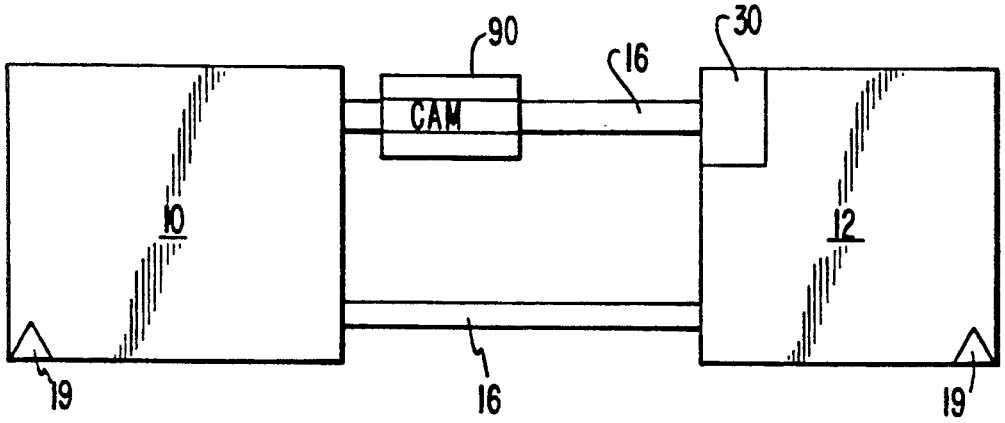
FIG. 2 is a top view of a portion of FIG. 1 showing the moving bolster, with a camming ramp located at a predetermined position along the bolster path.

In FIGS. 1 and 2, a schematic view is shown of a press, such as a large panel transfer press used in the automobile industry, designed by the reference numeral 10. The press 10 is conventionally equipped with a moving bolster shown generally at the reference numeral 12 on which a die 13 and gripper rail assemblies 14 are mounted in one of the ways known to the art. Such moving bolster arrangements are well known for assisting die changes in the press 10. Conventionally, a combination of a first die 13 on a moving bolster 12 is in production in the press 10 while a second set of a die and a moving bolster rests outside the press 10 and is prepared for the next production run. Thus, in this way, production runs for particular parts made from a particular die can be shortened if the down time from the die change is rapid and economical. Prior to the development of such moving bolster arrangements, die changes were costly so extended production runs were usually the norm rather than the exception. With the advent of moving bolsters of the type generally depicted in FIGS. 1 and 2, production runs could be more limited.

In such arrangements, a die 13 is clamped to the bolster 14 by die clamps generally shown at the reference number 17. The bolster includes sufficient pneumatic, electric, or hydraulic circuitry or components to permit the equipment to traverse laterally from the at-rest position to a production position within the press 10 for receiving the stamping anvil 11 of the press 10 in a mating relationship. The bolster also includes sufficient gripper rail assemblies (not shown) for gripping the rails 16 for movement as described. Usually, such circuits are pneumatic, so the invention is here discussed as a pneumatic circuit in its preferred embodiment.

The apparatus of FIGS. 1 and 2 is conventionally controlled by a programmable control 18 for automatically executing the total changeover process. The control 18 contains the data for the respective die sets, as well as data for the changeover of destackers and racking/stacking devices for finished parts. The steps in a die change, which are controlled automatically, include unclamping of the dies on the slide, uncoupling of gripper rail connections, raising and moving out the exchanged moving bolster and dies, moving in, lowering, centering and reclamping, as well as the changes of parts nests. All pressure, travel and speed parameters related to the new die set are called-up from memory and entered by the electronic control as set values.

A die change operation can be accomplished in about 10 minutes or less. For ease of monitoring, the individual phases of the changeover procedure are displayed locally and centrally on CRT's. Against this background of conventional equipment, the invention of this application relates to a deceleration valve and pneumatic circuit for application to this system.

Figure 3:
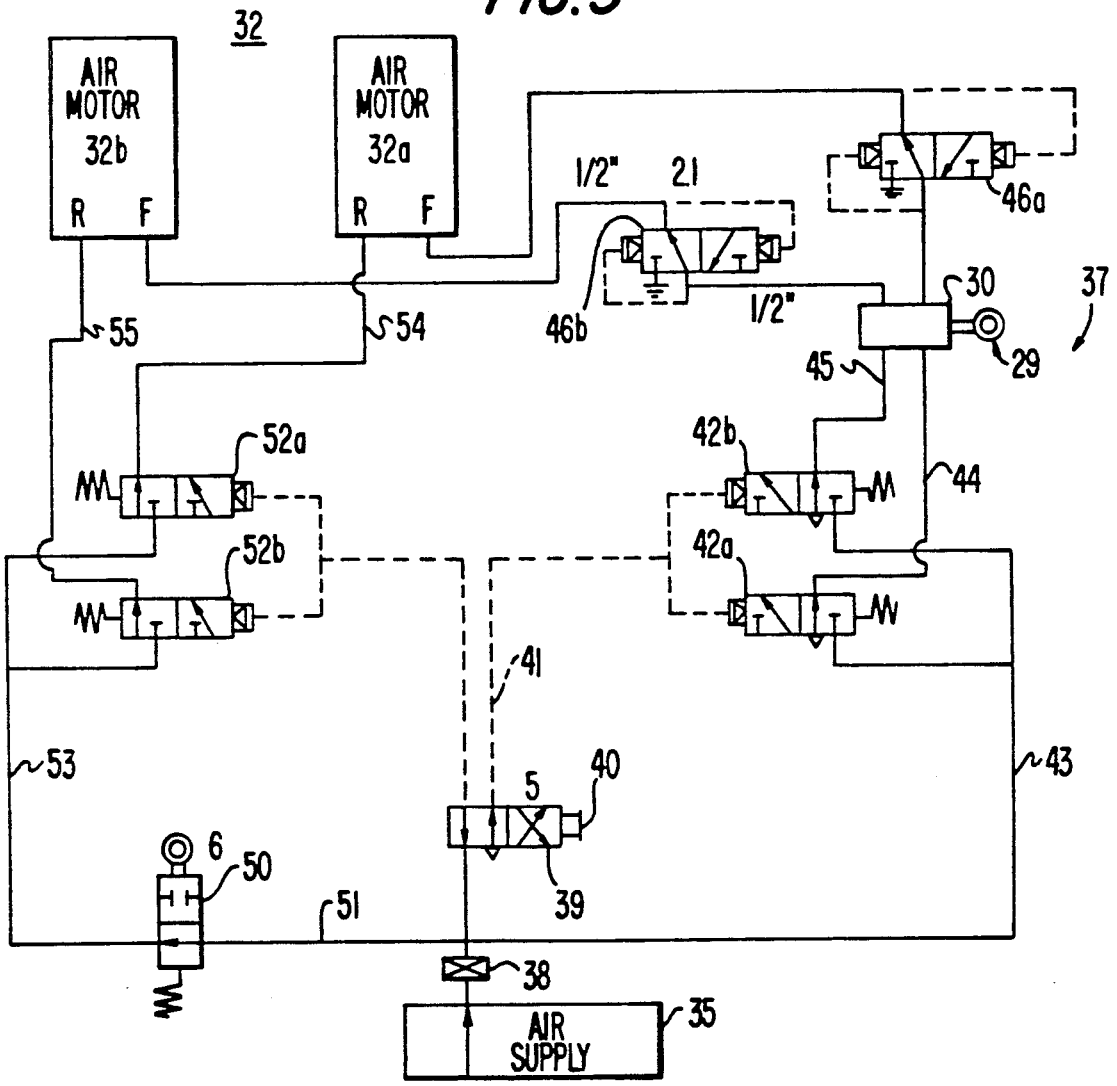
FIG. 3 is a pneumatic circuit according to the invention for controlling the deceleration of a moving bolster in a press.
Figure 6:
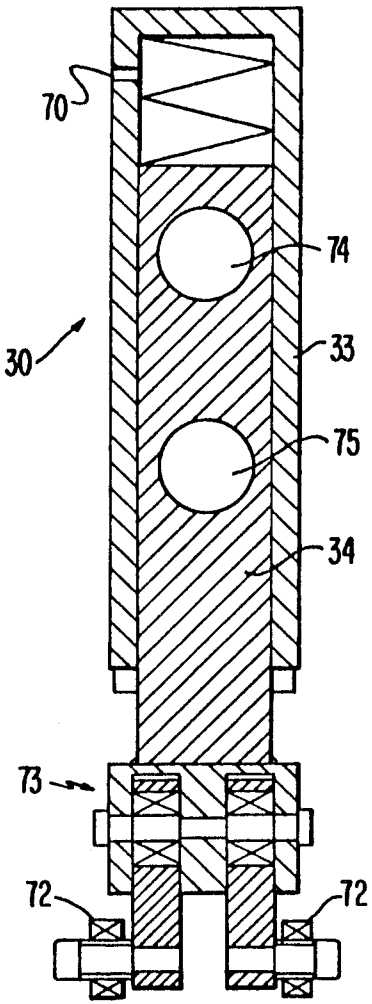
FIG. 6 is a cross-sectional view taken along line 6—6 of FIG. 4.
Figure 4:
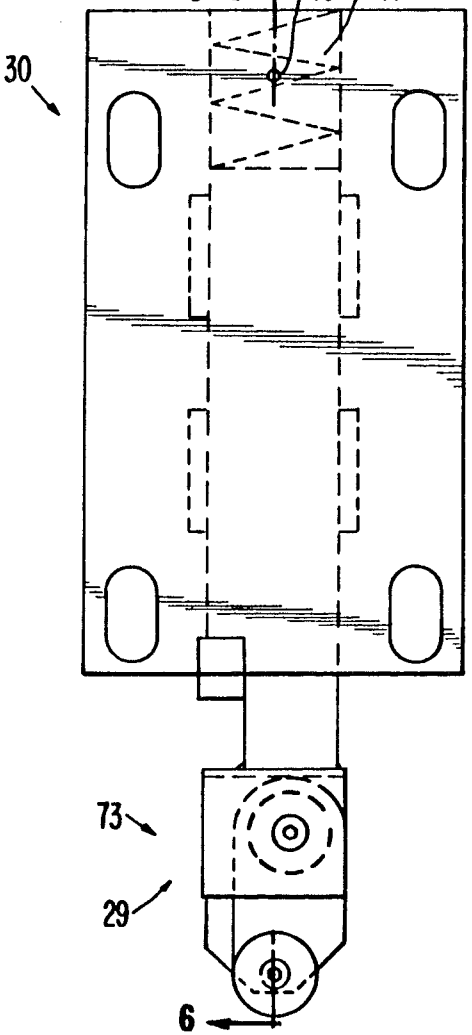
FIG. 4 is a side plan view of a deceleration valve preferably used in the circuit of FIG. 3 showing its cam-actuated operator for contacting the ramp of FIG. 2.
Figure 5:
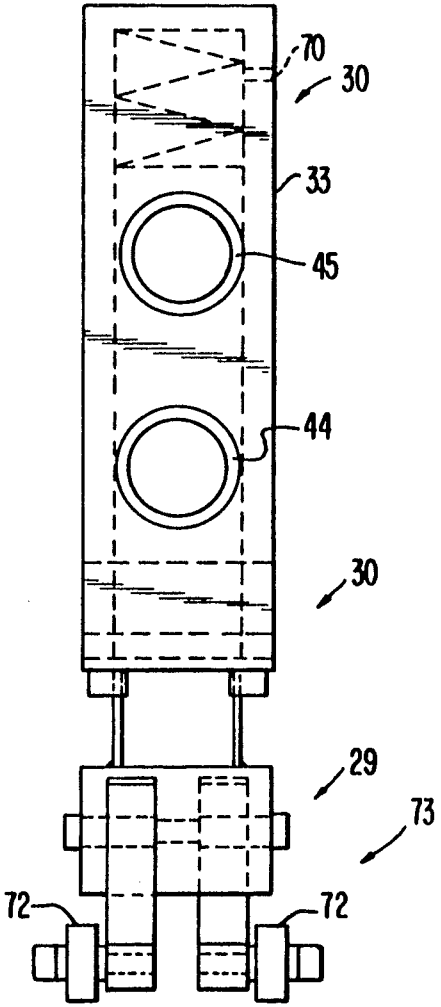
FIG. 5 is a frontal view of the deceleration valve of FIG. 4.

A deceleration valve 30, shown in detail in FIGS. 4 to 6, and referred to in the pneumatic circuit of FIG. 3, is mounted on the bolster 12, as seen in FIG. 2. The deceleration valve 30 is activated by contact between its cam roller 29 and a cam 90 shown in FIG. 7 mounted on the press bed adjacent to a rail 16. By the action of the deceleration valve 30, the main air lines running to an air motor 32 (seen in FIG. 3) are effectively rerouted through the deceleration valve 30 which in turn reduces the volume of air to the motor 32 when activated by the cam 90 causing the motor 32 to slow down. A feature of the deceleration valve 30, which will be discussed in greater detail, is that the valve has a limited clearance between the valve body 33 and the spool 34, such as about 0.010", thus allowing an internal by-pass of air to the motor 32 after the valve 30 is closed by the cam 90. The by-pass air may be used to idle the bolster 12 onto a stop 19 (FIG. 1) at a controlled rate of speed such as about 2 ft./min. The invention thus provides a significant improvement in the average speed of travel for a bolster 12 thus decreasing the time needed for a die change. Conventionally, the average speed of bolsters before modification according to the invention was about 10 to 15 ft./min., while the average speed after modification is about 30 to 35 ft./min.

Another significant feature of the invention as shown in the pneumatic circuit of FIG. 3 is that after the bolster 12 is on the stop 19, the main air supply 35 is shut off. A column of air is trapped between the motor 32 and the deceleration valve 30 which allows the bolster 12 to maintain a load on the stop 19 while the bolster 12 is lowered onto the press bed. The column of air is bled off to the atmosphere through a small air jet with a blow down time of about 20 seconds.

The pneumatic circuit for the invention is shown in FIG. 3 and is designated generally by the reference numeral 37. The circuit 37 includes an air supply source 35 such as a central air supply at the factory, connected by air hoses to the moving bolster 12. The air supply source 35 is connected through a manual or power actuated valve 38 to a 4-way, 2-position valve 39, having an actuator 40 for controlling a forward or a reverse direction for the air motor 32 and thus for the moving bolster 12. Assume first that the actuator 40 is positioned to control forward travel.

In that case, the air from the air supply 35 is channeled through the conduit 41 to a pair of directional valves **42*a* and 42*b* having a quick exhaust. When the valve 42*a* is open as determined by the presence of air from the line 41, air from the air supply 35 is provided through the conduit 43 through each of the valves 42***a* and 42*b* to the deceleration valve 30 through the conduits 44 and 45 respectively.

When the deceleration valve 30 is open, i.e. when the cam actuator 29 is not operative or in contact with the cam 90, air is supplied from the deceleration valve 30 to the forward port F of each of the air motors 32*a* and 32*b* through the quick exhaust valves 46*a* and 46*b* respectively.

Similarly, when the pilot-operated valve 39 is actuated to be in its reverse direction controlling position, air is supplied through the conduit 51 to a pair of directional valves 52*a* and 52*b* having a quick exhaust. When the valve 52*a* is open as determined by the presence of air from the valve 51, air from the air supply 35 is provided through the conduit 53 through each of the valves 52*a* and 52*b* to the 32*a* and 32*b* through the conduits 54 and 55 respectively.

A cam-operated valve 50 is positioned in the conduit 53 and is cam-actuated at the same time as the deceleration valve 30 to coordinate forward and reverse operations of the circuit. The circuit of FIG. 3 and its operation can be understood by those skilled in the art so further detailed discussion is not believed to be necessary.

In operation, the bolster 12 is thus caused to travel in a forward or a reverse direction according to the operation of the air motors 32*a* and 32*b*. Assuming that the forward direction is equivalent to withdrawal of the bolster 12 from the press 10, it can be noted that when the cam-actuator 29 for the deceleration valve 30 rides over the cam surface 91 of FIGS. 2 and 7 in the forward direction, the deceleration valve 30 is closed this stopping forward motion of the air motors 32*a*, 32*b*. At the same time, the valve 50 is also actuated, thus supplying air through the valve 50 to the valves 52*a* and 52*b*, thus reversing the drive on the air motor to stop the bolster 12 at a predetermined position. That predetermined position is at the stop 19; thus the position of the cam surface 91 of FIGS. 2 and 7 is located at a site which causes the bolster 12 to stop at the stop 19 given its momentum as determined by its mass and its velocity at the location of the stop, with the aid of the reversal of the motors 32*a*, 32*b*.

When the air to the motors 32*a*, 32*b* is in a reverse mode, as described, after actuation of the values 30, 50 by the cam 91, a release path for the air from the motors 32*a*, 46*b* is defined. The gap between the spool 34 and the valve body thus controls the exit of air in the reverse mode to cause the motors to idle onto the stop 19. Once positioned, the air further blows down through the pilot hole 70. The spool 34 is biased open by a spring 71.

The cam roller 29 includes a pair of wheels 72 rotatably secured to an assembly 73 at the lowermost end of the spool 34. When the wheels contact the ramp 91, the spool 34 is forced upwardly, causing its through openings 74, 75 to deregister from the input ports 44*a*, 45*a* connected to the lines 44, 45.

Figure 7:
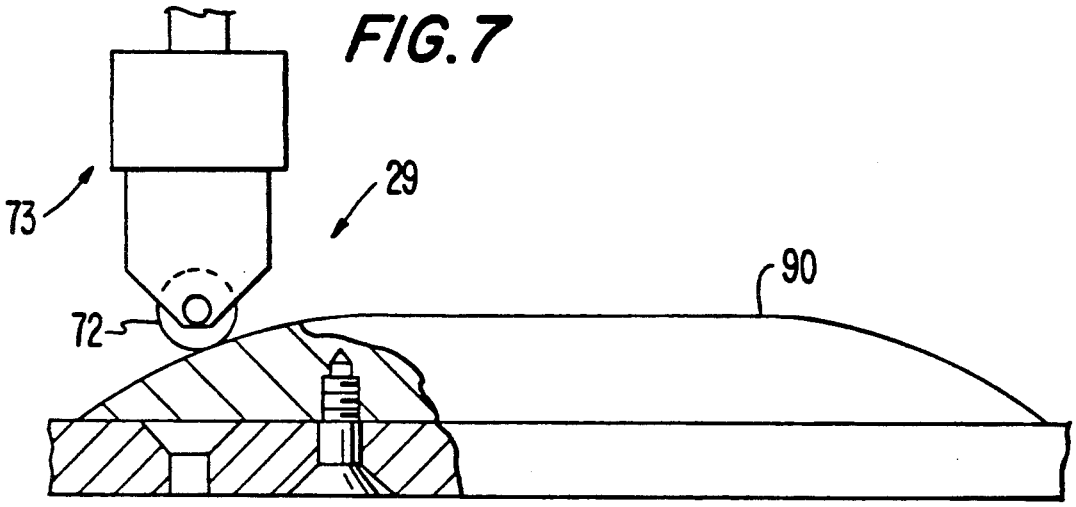
FIG. 7 is a side view of the camming ramp mounted on the rails as shown in FIG. 2 for actuating the deceleration valve of FIGS. 4 to 6 in the circuit of FIG. 3.

FIG. 7 shows a side view of the cam surface 90 secured to the press bed as in FIGS. 1 and 2. As explained above, the cam surface 91 actuates the deceleration valve 30 and the valve 50 as shown and discussed in connection with FIGS. 3 to 6. As shown, the ramp surface 91 is in the shape of a gentle curve so that when the cam-actuators 29 contact the cam surface 91, the movement of the spool 34 is smooth and free. The surface 91 could also be arranged to assume alternate shapes to provide desired and predetermined opening and closing characteristics for the deceleration valve when controlling the operation of the air motor.

While this invention has been described as having a preferred design, it will be understood that it is capable of further modification within the spirit of the invention. This application is, therefore, intended to cover any variations, uses, or adaptation of the invention following the general principles thereof and including such departures from the present disclose as come within know or customary practice in the art to which this invention pertains and fall within the limits of the appended claims.

What is claimed is:

1. A control circuit for a moving bolster used in connection with a press wherein the bolster traverses a predetermined path to and from said press to change dies mounted on said bolster, said control circuit comprising:

motor means for selectively actuating said moving bolster in a forward or a reverse direction along said predetermined path, a source of supply for said motor controlled by said circuit means, including supply control valves;

a deceleration valve in circuit with said control valves for supplying motive power to said motor means in normal operation to drive said moving bolster, said deceleration valve being responsive to a predetermined location along said predetermined path to cease motive power to said motor means, whereby said moving bolster decelerates to a stop at a predetermined location at or near the end of said predetermined path; and valve means for cooperating with said motor means for causing said motors to operate in a reverse direction, said valve means including a pilot valve responsive to said predetermined location along said predetermined path to control said reverse operation of said motor means.

2. The circuit as set forth in claim 1 wherein said source of supply is an air supply, said motor means are pneumatic motors, and said circuit is a pneumatic circuit.

3. The circuit as set forth in claim 2 wherein a ramp is provided at said predetermined location and said deceleration valve is located on said moving bolster so that said deceleration valve is actuated by contact with said ramp.

4. The circuit as set forth in claim 3 wherein said pilot valve is also actuated by said ramp.

5. The circuit as set forth in claim 3 wherein said deceleration valve has a valve body and a spool mounted in said valve body with a predetermined clearance between said spool and said valve body to permit a leakage of air to bleed off aid between said valve means and said motor means when said deceleration valve is actuated.

* * * * *